US009464375B2

(12) United States Patent
Willey et al.

(10) Patent No.: US 9,464,375 B2
(45) Date of Patent: Oct. 11, 2016

(54) KIT FOR TREATING A SUBSTRATE

(71) Applicant: The Procter & Gamble Company, Cincinnati, OH (US)

(72) Inventors: Alan David Willey, Cincinnati, OH (US); Philip Andrew Sawin, Cincinnati, OH (US); John Todd Dipre, Cincinnati, OH (US); Gary Joseph Foose, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/594,192

(22) Filed: Jan. 12, 2015

(65) Prior Publication Data

US 2015/0211170 A1 Jul. 30, 2015

Related U.S. Application Data

(60) Provisional application No. 61/931,028, filed on Jan. 24, 2014.

(51) Int. Cl.

| | |
|---|---|
| ***D06F 39/02*** | (2006.01) |
| ***A47L 15/44*** | (2006.01) |
| ***D06F 35/00*** | (2006.01) |
| *A47L 15/00* | (2006.01) |

(52) U.S. Cl.

CPC ..... *D06F 39/02* (2013.01); *A47L 15/44* (2013.01); *A47L 15/4445* (2013.01); *D06F 35/00* (2013.01); *A47L 15/0002* (2013.01); *A47L 2601/10* (2013.01); *A47L 2601/20* (2013.01)

(58) Field of Classification Search

CPC ..... A47L 15/44; A47L 15/4445; A47L 2601/20; A47L 2601/10; A47L 15/0002; D06F 39/02; D06F 35/00

See application file for complete search history.

(56) References Cited

U.S. PATENT DOCUMENTS

| | | | |
|---|---|---|---|
| 3,393,153 | A | 7/1968 | Zimmerer et al. |
| 3,714,151 | A | 1/1973 | Lyness |
| 3,916,652 | A | 11/1975 | Speakman |
| 3,927,967 | A | 12/1975 | Speakman |
| 4,524,014 | A | 6/1985 | Finch et al. |
| 4,526,700 | A | 7/1985 | Hensley |
| 4,602,097 | A | 7/1986 | Curtis |
| 4,985,559 | A | 1/1991 | Goldberg et al. |
| 5,057,236 | A | 10/1991 | Petrin et al. |
| 5,082,578 | A | 1/1992 | Langer et al. |
| 5,236,464 | A | 8/1993 | Green et al. |

(Continued)

FOREIGN PATENT DOCUMENTS

| | | | |
|---|---|---|---|
| CA | 2079358 | A1 | 3/1993 |
| DE | 2335570 | A1 | 1/1974 |

(Continued)

OTHER PUBLICATIONS

International Search Report and Written Opinion, dated Mar. 10, 2015, U.S. Appl. No. 14/594,194, 12 pgs.

(Continued)

*Primary Examiner* — Kishor Mayekar
(74) *Attorney, Agent, or Firm* — Jason J Camp

(57) ABSTRACT

A kit having a light housing having a source of light; and a container containing a photocatalyzable treatment composition having a photoactivator, wherein the light housing and the container are co-packaged with one another.

20 Claims, 9 Drawing Sheets

(56) References Cited

U.S. PATENT DOCUMENTS

| | | | | |
|---|---|---|---|---|
| 5,330,672 | A | 7/1994 | Langer et al. | |
| 5,697,230 | A | 12/1997 | Ender et al. | |
| 5,834,412 | A | 11/1998 | Rohrbaugh et al. | |
| 6,150,494 | A | 11/2000 | Wang et al. | |
| 6,524,529 | B1 | 2/2003 | Horton | |
| 7,081,225 | B1 | 7/2006 | Hollander | |
| 2004/0171505 | A1* | 9/2004 | Nonami | A01N 59/26 510/302 |
| 2004/0259023 | A1 | 12/2004 | Campagnola et al. | |
| 2004/0259747 | A1 | 12/2004 | Schmidt et al. | |
| 2005/0126609 | A1 | 6/2005 | Son et al. | |
| 2005/0150528 | A1 | 7/2005 | Kim | |
| 2005/0155633 | A1 | 7/2005 | Daume et al. | |
| 2006/0097222 | A1 | 5/2006 | Doona et al. | |
| 2007/0214577 | A1 | 9/2007 | Bianchetti et al. | |
| 2009/0145452 | A1 | 6/2009 | Anderson et al. | |
| 2009/0170744 | A1 | 7/2009 | Meine et al. | |
| 2009/0194474 | A1 | 8/2009 | Tranchant et al. | |
| 2011/0057123 | A1 | 3/2011 | Ho | |
| 2011/0180118 | A1 | 7/2011 | Schrott | |
| 2011/0217202 | A1 | 9/2011 | Winterton | |
| 2011/0315709 | A1 | 12/2011 | Fileccia et al. | |
| 2012/0055513 | A1 | 3/2012 | Eglmeier et al. | |
| 2013/0032610 | A1 | 2/2013 | Muller | |
| 2014/0084024 | A1 | 3/2014 | Benda et al. | |
| 2014/0142302 | A1 | 5/2014 | Furuyama et al. | |

FOREIGN PATENT DOCUMENTS

| | | | |
|---|---|---|---|
| DE | 102010030046 | A1 | 2/2011 |
| DE | 202012102250 | U1 | 11/2012 |
| EP | 2366323 | A1 | 9/2001 |
| EP | 2113605 | | 11/2009 |
| GB | 1372036 | A | 10/1974 |
| KR | 20070082389 | A | 8/2007 |
| WO | WO 9859030 | A1 | 12/1998 |
| WO | WO-2008/128818 | A1 | 10/2008 |
| WO | WO 2012032283 | A1 | 3/2012 |

OTHER PUBLICATIONS

International Search Report and Written Opinion, dated Mar. 30, 2015, U.S. Appl. No. 14/594,190, 10 pgs.

International Search Report and Written Opinion, dated Mar. 31, 2015, U.S. Appl. No. 14/594,191, 9 pgs.

International Search Report and Written Opinion, dated Apr. 17, 2015, U.S. Appl. No. 14/594,189, 10 pgs.

International Search Report and Written Opinion, dated Apr. 15, 2015, U.S. Appl. No. 14/594,187, 10 pgs.

International Search Report and Written Opinion, dated Mar. 25, 2015, U.S. Appl. No. 14/594,192, 10 pgs.

International Search Report and Written Opinion, dated Mar. 31, 2015, U.S. Appl. No. 14/594,195, 11 pgs.

International Search Report and Written Opinion, dated Mar. 30, 2015, U.S. Appl. No. 14/594,196, 12 pgs.

F. Zaragoza Dorwald, "Side Reactions in Organic Synthesis", 2005, Wiley-VCH Verlag GmbH & Co. KGaA, Weinheim, Preface. p. IX.

Okubayashi et al., Journal of Applied Polymer Science, "Improvement of Wettability of Hydrophobic Films by Impregnation of Anthraquinone Attached to Polyoxyethylene Glycol", 2005, vol. 97, pp. 545-549.

Corrales et al., Journal of Photochemistry and Photobiology A: Chemistry, "Novel water soluble copolymers based on thioxanthone: photochemistry and photoinitiation activity", 2005, 169, pp. 95-100.

Corrales et al., Journal of Photochemistry and Photobiology A: Chemistry, "Free radical macrophotoinitiators: an overview on recent advances", 2003, 159, pp. 103-114.

Allen et al., European Polymer Journal, "Photochemistry of Thioxanthones-III Spectroscopic and Flash Photolysis Study on Hydroxy and Methoxy Derivatives", 1986, vol. 22, No. 9, pp. 691-697.

U.S. Appl. No. 14/594,187, filed Jan. 12, 2015, Alan David Willey et al.

U.S. Appl. No. 14/594,189, filed Jan. 12, 2015, Alan David Willey et al.

U.S. Appl. No. 14/594,190, filed Jan. 12, 2015, Alan David Willey et al.

U.S. Appl. No. 14/594,191, filed Jan. 12, 2015, Randall Alan Watson et.

U.S. Appl. No. 14/594,194, filed Jan. 12, 2015, Alan David Willey et al.

U.S. Appl. No. 14/594,195, filed Jan. 12, 2015, Alan David Willey et al.

U.S. Appl. No. 14/594,196, filed Jan. 12, 2015, Alan David Willey et al.

* cited by examiner

KIT FOR TREATING A SUBSTRATE

FIELD OF THE INVENTION

Kit for treating a substrate, for example dishware or laundry.

BACKGROUND OF THE INVENTION

Even with all the improvements in dish and laundry detergent formulations for washing dishes and laundry over the last twenty years, cleaning soiled dishes and laundry having certain types of stains remains problematic. Cleaning reusable plastic dishware can be particularly challenging. Plastic tubs having lids are commonly used for storing leftover food. Anyone who has stored food in such plastic containers has experienced the plastic becoming stained. This is because many foods contain natural and artificial dyes. Foods such as cherries and blueberries have red to blue anthocyanin dyes. Orange-red carotenoids such as lycopene and beta-carotene are found in tomatoes or carrots. Yellow curcuma dyes are found in curry and mustard. Of course, the above foods also on occasion end up spilled upon clothing articles, resulting in stains that are difficult to remove.

Conventional dish laundry detergent compositions include bleaching agents such as sodium percarbonate and use amine cobalt salt as a bleach catalyst. Some dish and laundry detergent formulations use sodium hypochlorite as a bleaching agent. Automatic dishwasher detergent composition formulations and laundry detergent formulations employing such bleaching agents have varying degrees of efficacy with such efficacy not always meeting consumer desires. Depending on the particular automatic dishwasher detergent composition being used, it is not uncommon for plastic food storage tubs to remain stained after washing. Similarly, sometimes stains on clothing are not removed to a satisfactory degree when washed in an automatic dishwasher.

Other benefit active ingredients might be desirable in automatic dishwasher detergent and laundry detergent compositions. For example, it might be desirable to include benefit active ingredients such as stain removers, bactericides, and active ingredients for eliminating endospores on dish, cooking ware, and clothing.

There are many benefit active ingredients that can conceivably be included in dish and laundry detergent compositions. Of course, there are many technical challenges to integrating such benefit active ingredients into commercially viable dishwasher detergent compositions. Many benefit active ingredients may not be chemically stable in powder, liquid, or gel formulations. Dish and laundry detergent compositions having certain benefit active ingredients may not be physically stable. Some benefit active ingredients may not be environmentally stable. For instance, changes in temperature and humidity may have adverse effects on the composition. Further, some benefit active ingredients may be incompatible with other components of dishwasher detergent compositions.

An alternative approach for enabling the inclusion of certain benefit active ingredients in dishwasher detergent compositions is the use of photo-activated chemistry. For instance, micronized titanium dioxide in water can be activated by light to become a bleaching system. Photoactivators such as phthalocyanines and naphthalocyanines, including sulphonated zinc phthalocyanine, can be effective as a photo bleaching agent and antimicrobial agent. Similarly, such benefit active ingredients can be provided in a composition separate from a fully formulated dish or laundry detergent.

One bather to employing photoactive chemistry in dish and laundry detergents is the necessity of irradiating the cleaning composition within the dishwasher or laundry washing machine during the cycle. Dishwashing and laundry washing machines can be provided with interior lights at the time of manufacture. However, if an efficacious detergent that includes photoactive chemistry is developed, the vast majority of appliances that are presently in consumers households are without such interior lighting. It is unlikely that consumers will purchase a new appliance to take advantage of a detergent that employs photoactive chemistry. In view of that, even if a developer of detergents develops a fantastic breakthrough composition employing photochemistry, only a limited fraction of consumers will be able to see the benefit. The volume of dishwasher detergent composition required to supply the limited fraction of consumers who might be willing to purchase an appliance having interior lighting may not be a justifiable business proposition. Nor may it be attractive for a business to wait over time, perhaps many years, until new models of dishwashers having the interior lighting make their way into consumers' households.

With these limitations in mind, there is a continuing unaddressed needed for methods and devices that will provide consumers with the ability to take advantage of photoactive chemistry in dishwashing and laundry washing without the need to purchase a new expensive appliance having integral interior lighting.

SUMMARY OF THE INVENTION

One embodiment of the present invention is a method for treating dishware comprising the steps of: providing a treatment composition comprising a photoactive component; contacting in an appliance said treatment composition with said dishware; and irradiating said treatment composition with visible light; wherein the step of irradiating said treatment composition with visible light is performed with a source of light that is tool free insertable into and removable from said appliance.

Another embodiment of the present invention is a method for treating laundry comprising the steps of: providing a treatment composition comprising a photoactive component; contacting in an appliance said treatment composition with said laundry; and irradiating said treatment composition with visible light; wherein the step of irradiating said treatment composition with visible light is performed with a source of light that is tool free attachable to and detachable from an interior portion of said appliance.

Another embodiment of the present invention is a lighted dispenser comprising: a light housing comprising a power source and source of light conductively connected to said power source; and a treatment composition reservoir operatively connected to said light housing, said reservoir comprising a dispensing outlet; wherein said lighted dispenser is sized and dimensioned to fit within an interior portion of a washing appliance.

Another embodiment of the present invention is a kit for treating a substrate comprising: a light housing comprising source of light; and a container containing a photocatalyzable treatment composition comprising a photoactivator; wherein said light housing and said container are co-packaged with one another.

DETAILED DESCRIPTION OF THE INVENTION

Figure 1:
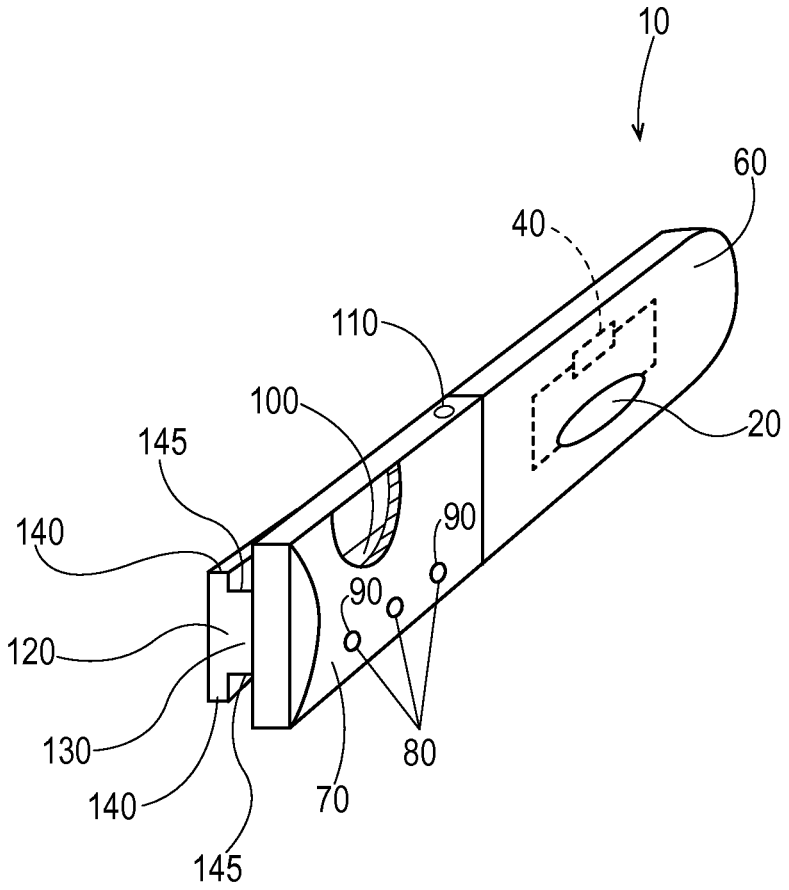
FIG. 1 is a dispenser having a source of light and a reservoir that a consumer can put into an appliance.

A photoactive component can be provided in or with dish and laundry detergent formulations in different forms. For instance, the photoactive chemistry may be provided in a fully formulated powder, liquid, gel, or a unit dose dissolvable pouch. Photoactive chemistry can also be provided in a composition separate from a fully formulated dish or laundry detergent. If provided as a separate composition, the composition having photoactive chemistry can be delivered to the wash prior to, during, or after the fully formulated detergent has been delivered in the wash.

To take advantage of laundry and detergent compositions that include a photoactive component it is desirable to provide for a source of light. A source of light can be provided integrally with a dishwasher or laundry washing machine. Further, a source of light can be integrally powered by the dishwasher or laundry washing machine. A source of light generates electromagnetic radiation.

An appliance might be provided with one or more waterproof light fixtures that shine into the cabinet that contains the substrate being cleaned. Such light fixtures can be recessed into the cabinet walls, ceiling, or floor and direct light into the cabinet. In the case of a dishwasher, the light may irradiate the wash liquor, and any photoactive component provided therein, as it is circulated through various dispensing arrays onto the dishes being cleaned.

Similarly, for laundry washing machines, waterproof light fixtures may shine within the cabinet that contains the washing drum or within the drum itself. For instance, in an upright washer, recessed lights may be provided in the walls of the drum and direct light towards the center of the drum. The lights may be towards the lower part of the drum so that when the drum is filled or partially filled with wash liquor containing a photoactive component, the lights irradiate the wash liquor to activate the photoactive component. Of course, the lights may be affixed to or within the top door on an upright laundry washing machine and direct light downwardly on the wash liquor or at the outlet from which water is dispensed into the drum. In laundry washing machines that have a porous drum, such drum is housed within a shell, the shell being the component that contains the wash liquor. It may be advantageous to have the lights shine into this shell to activate any photoactive component provided in the wash liquor. Such an arrangement can make the technical aspects of providing for light simpler since the lights do not have to come into contact with the articles being washed.

It is also possible to have the source of light shine upon the wash liquor as it is stored in a reservoir of the appliance or travels through or within a pump, conduit, or other liquid conveyance element. Such an approach might be desirable so that the articles being cleaned do not obstruct the light from irradiating the photoactive component in the wash liquor.

The light activity of various photoactive components can vary. For instance, some photoactive components may be activated by ultraviolet light and/or visible light. If ultraviolet light activates the photoactive component, then it may be more practical to have the source of light positioned in the appliance so that the consumer cannot make visual contact with the source of light. Such arrangements might best be provided for by having the light irradiate upon the wash liquor as the wash liquor passes through a conduit during circulation. Constructing an appliance to be configured as such can be done relatively easily. However, it can be challenging for a consumer to change the source of light in the event that the source of light burns out or becomes faulty if the source of light is embedded deeply into the appliance.

If the source of light is in the drum of the appliance or ceiling or floor of the appliance, it may be relatively easy for the consumer to change the source of light in the event that the light burns out or becomes faulty. There are some challenges with placing the source of light as such. Firstly, if ultraviolet light is used, adequate controls might be required to be used in the appliance to ensure that the ultraviolet light cannot be activated when the door of the appliance is open. Secondly, the waterproof sealing mechanisms must be robust enough so that leaks do not occur after the consumer has changed the source of light and it is technically simple enough for a typical consumer to change the source of light.

The source of light can be one or more light emitting diodes, incandescent tungsten filament lightbulbs, Hg(Ar) UV lamps, fluorescent lamps, compact fluorescent lamps, cold cathode fluorescent lamps, high intensity discharge lamps, or other such light source. The source of light needs to have some spectrum that is in harmony with the wavelength or range of wavelengths that the photoactive component is tuned to.

Still yet another alternative approach is to have the source of light remote from where the washing occurs and transport the light via fiber optic cable, or other conveyance, from the source of light to where the wash liquor contacts the article being cleaned.

In view of the above complexity, it is apparent that it will be cost and convenience prohibitive to retrofit appliances manufactured without an interior lighting system to include a lighting system that is powered by the appliance itself. One option for overcoming this challenge is to provide for a portable source of light that a consumer can put into the appliance.

Lighted Dispenser

A dispenser 10 having a source of light 20 and a reservoir 70 that a consumer can put into an appliance is shown in FIG. 1. The dispenser 10 can be a portable device that is sized and dimensioned to fit within the interior portion of a washing appliance without interfering with any of the moving parts of the machine into which the dispenser 10 is inserted or any of the contents thereof. The interior portion can be considered to be, for instance, the drum of a laundry washing machine. For a dishwashing appliance, the interior portion can be considered to be the space in which the racks and dishware reside when the dishwasher is operated.

Typical household dishwashing appliances and laundry washing machines have a washing space that is less than about 1 $m^3$ or even less than about 0.7 $m^3$, or even less than about 0.5 $m^3$. The dispenser 10 can have a volume less than about 6000 $cm^3$. The dispenser 10 can have a volume less than about 3000 $cm^3$. The dispenser 10 can have a volume less than about 1500 $cm^3$. The dispenser 10 can have a volume less than about 750 $cm^3$. The dispenser 10 can have a volume less than about 325 $cm^3$. The dispenser 10 can have a volume less than about 150 $cm^3$.

The dispenser 10 can have a low profile. Low profile is used in the sense that the dispenser 10 is generally thin. For example, the dispenser 10 can have a thickness as measured in the direction in which light is emitted from the source of light 20 of less than about 5 cm, or even less than about 2 cm, or even less than about 0.5 cm.

The dispenser 10 can be designed such that part of the device contains the components for providing light and the other part can be a liquid delivery system. The components for providing light can include a power source 40. The power source can be a battery. The battery can be a conventional AA, C, D, or other standard size battery. The battery can be a nickel-cadmium, lithium ion, or other type of battery. The power source 40 can be a dynamo built into the dispenser and movement of the dispenser drives the dynamo to generate a current that powers the source of light 20.

The power source 40 can be conductively connected to the source of light 20. By conductively connected it is meant that the power can be transferred from the power source 40 to the source of light 20, for instance by a direct connection in a circuit, induction, or any other technical approach known for transferring energy from a power source 40 to a source of light 20. The power source 40 can be connected via wires 50 in an electrical circuit that includes the source of light 20. Of course, more complicated circuitry is contemplated, such as an on/off switch, a timer, or programmable logic controller that can control the on and off, brightness, spectrum, or other attribute of the light emitted from the source of light 20.

The dispenser 10 can have a light housing 60. The light housing 60 can comprise the power source 40 and the source of light 20 conductively connected to the power source 40. The dispenser 10 can further comprise a treatment composition reservoir 70 operatively connected to the light housing 60. That is, the reservoir 70 and light housing 60 can be joined to one another for instance by the reservoir 70 and light housing 60 being comprised of materials that are integral with one another or joined to one another. For instance, an embodiment is contemplated in which the dispenser 10 is comprised of one or more injection molded parts that are snapped or otherwise joined together to form the dispenser 10.

The reservoir 70 can comprise a dispensing outlet 80. The dispensing outlet 80 can be a weep hole 90. The reservoir 70 can comprise a plurality of weep holes 90. The weep holes 90 can be sized and dimensioned to slowly dispense treatment composition 100. The weep holes 90 can be circular and have a diameter of 2 mm or less. The number of and dimensions of the weep holes 90 can depend on the hydrodynamic properties of the treatment composition 100. It is contemplated that the flow rate from the dispensing outlet 80 can be controlled. For instance, the weep holes 90 may have an adjustable obstruction that restricts flow from the weep hole 90, for instance a cover or obstruction that partially blocks the open cross section of the weep hole 90.

The light housing 60 and the reservoir 70 can be arranged in a side by side relationship. Alternatively, the light housing 60 can be arranged so that in use, the reservoir 70 is above the light housing 60 so that when treatment composition 100 is dispensed from the reservoir 70, it passes by the source of light 20. Such a design might be practical so that the treatment composition 100, which might contain photoactive chemistry, is activated as it is dispensed from the reservoir 70.

The source of light 20 can be a light emitting diode, incandescent light, an incandescent tungsten filament lightbulb, Hg(Ar) UV lamp, fluorescent lamp, compact fluorescent lamp, cold cathode fluorescent lamp, high intensity discharge lamp, or other such light source. The power source 40 needs to provide sufficient power to power the source of light 20 to the degree needed. The power source 40 can be a single use power source or can be capable of powering the source of light 20 over multiple uses.

The reservoir 70 can have an inlet port 110. The inlet port 110 can provide for an opening in the reservoir 70 through which treatment composition 100 can be delivered into the reservoir 70. The inlet port 110 can be a stopper, a lug and key stopper, screw in plug, or the like, such that the treatment composition 100 can be conveniently placed into the reservoir 70.

In the view shown in FIG. 1, a section of the reservoir 70 is illustrated as being removed so as to illustrate the treatment composition 100 residing in the reservoir 70. The treatment composition 100 can be driven through the dispensing outlet 80 by gravity flow. Other approaches for dispensing the treatment composition 100 from the reservoir 70 are contemplated, including by a pump that is electromechanically driven or mechanically driven by the consumer setting a spring loaded trigger activated pump.

The dispenser 10 can further comprise a locking member 120 operatively connected to one or both of the light housing 60 and treatment composition reservoir 70. The locking member 120 shown in FIG. 1 is but one example of a possible locking member 120 that may be employed with the dispenser 10. The locking member 120 can comprise a body 130 having one or more fins 140 extending from the body 130. The body 130 can extend lengthwise along the dispenser 10. The body 130 could be in vertical alignment with the dispenser 10.

Figure 2:
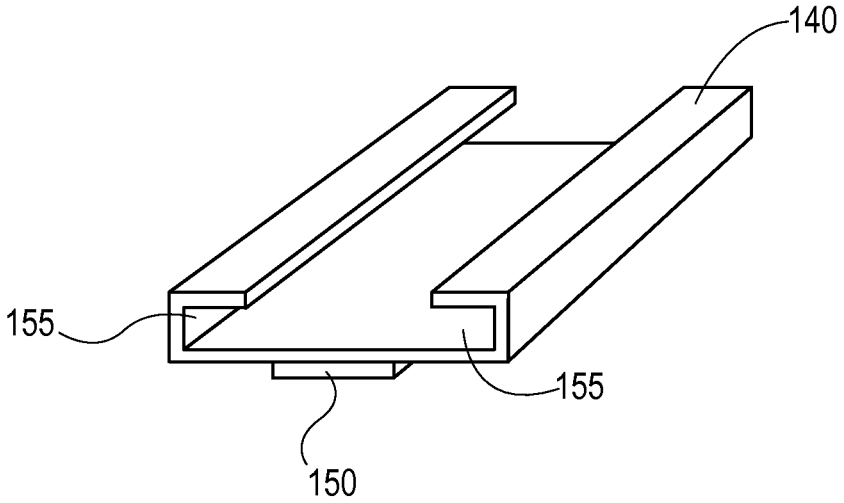
FIG. 2 is a carrier for a dispenser.

The locking member 120 can be tool free attachable to and detachable from a carrier 140, a carrier 140 being shown in FIG. 2. By tool free attachable to and detachable from, it is meant that the consumer can attach and detach the pertinent structure without using any tools that provide mechanical advantage. Rather, she can simply manipulate the thing to be manipulated with only her fingers. The consumer does not need to employ a screwdriver, pliers, hammer, or other implement that provides mechanical advantage to the force that can be provided by the consumer's hand.

For instance, the consumer can attach and detach the locking member 120, and thereby the dispenser 10, from the carrier 140 without using any tools. That is, the locking member 120 can be attached to and detached from the carrier 140 by hand without the aid of any tool providing mechanical advantage.

The locking member 120 can be slideably engageable with the carrier 140. For instance, the locking member 120 can have a T-shape and the carrier 140 can have a pair of slots 145 sized and dimensioned to receive the fins 140 of the T-shaped locking member 120. In use, the consumer can slide the locking member 120 into the complementing carrier 140. In the embodiment shown in FIGS. 1 and 2, the arms of the T-shaped locking member 120 can be slid into the complementing grooves 155 of the carrier 140.

The carrier 140 can comprise an adhesive 150 attached to a side of the carrier 140 opposing the locking member 120. In use, the adhesive 150 can connect the carrier 140 to the interior portion of a dishwasher (for example the walls, floor, ceiling, door, rack, spindle) or laundry washing machine (for example the drum, lid, back or front wall in a side entry laundry washing machine). The adhesive 150 needs to be strong enough to secure the dispenser 10 to the washing apparatus. The adhesive 150 needs to be chemically compatible with the wash liquor so that the adhesive 150 does not release the carrier 140 during washing.

Figure 3:
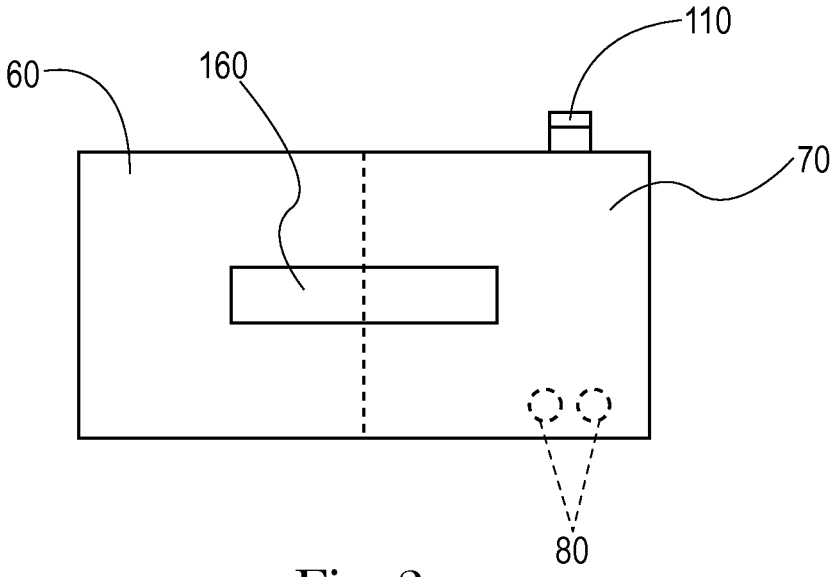
FIG. 3 is a dispensing apparatus comprising a magnet operatively attached to the dispensing apparatus.

The dispensing apparatus 10 can comprise a magnet 160 operatively attached to the dispensing apparatus 10, as shown in FIG. 3. As shown in FIG. 3, a magnet 160 can be affixed to or integral with the dispenser 10 and be on the opposite side of the dispenser 10 from the source of light 20 and dispensing outlet 80. In use, the magnet 160 can serve to attach the dispensing apparatus 10 to a metal surface or component of the interior portion of the washing appliance.

The dispenser 10 can be fabricated out of plastic or metal.

Figure 4:
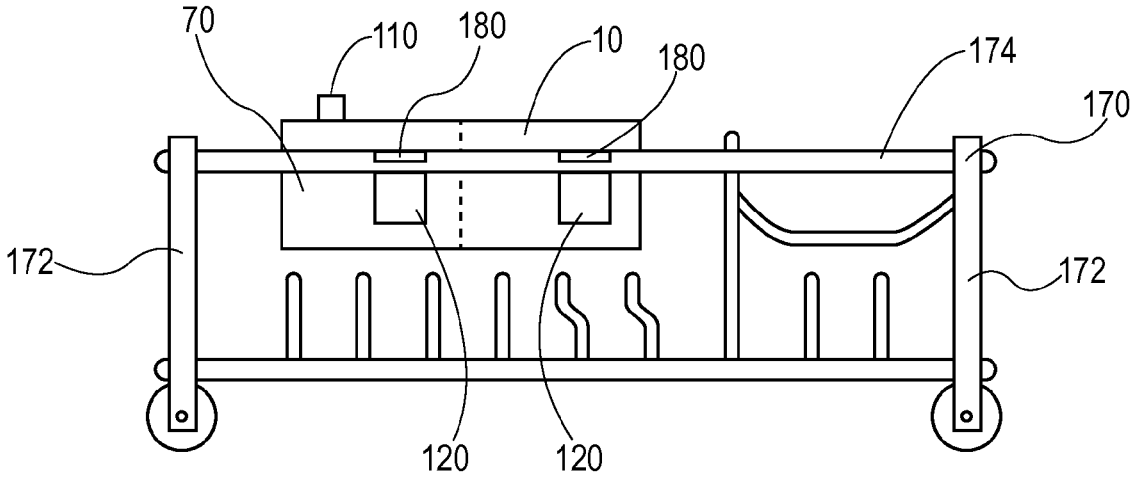
FIG. 4 is a dispensing apparatus having locking members that are tool free attachable to and detachable from a rack or other mobile component that is in an appliance.

The dispensing apparatus 10 can comprise one or more locking members 120 that are tool free attachable to and detachable from a rack 170 or other mobile component that is in the appliance, as shown in FIG. 4. The locking member 120 can be a hook 180. The locking member 120, or members 120, can be any structure that can be secured to a portion of a rack 170. The rack 170 can be that of the ordinary type found in dishwashers designed for in-home use. Typically the rack 170 has an open web like structure that allows wash liquor to be sprayed there through. The rack 170 can have one or more columns 172 or beams 174 interconnected with one another. The one or more hooks 180 can be sized and dimensioned to hang upon a rack 170. Alternatively, the locking member 120 can be a clip, expand-to-fit wedge, or any other structure that can be secured to the rack 170.

The source of light 20 can generate a radiant flux of between about 1 mW to about 500 W. For application in an automated dishwasher, the source of light 20 can generate a radiant flux of between about 1 mW to about 500 W, alternatively between about 1 W and about 250 W, alternatively between about 2 W to about 100 W. For application in an automated laundry washing machine, the source of light 20 can generate a radiant flux of between about 250 mW to about 500 W, alternatively about 500 mW to 250 W, alternatively about 1 W to about 100 W. The radiant flux of the source of light 20 is measured at the wavelength of maximum absorbance of its emission by the by the photoactive component. The source of light 20 can emit light having wavelengths between about 380 nm and about 800 nm.

Treatment Composition

Photobleach

The treatment composition 100 can comprise a photoactive component that is a photoactive bleaching agent. For instance, a suitable photoactive bleaching agent can be titanium dioxide. Radiation in the visible spectrum of between about 380 nm and about 800 nm can activate the titanium dioxide for the purposes of photo-bleaching. Titanium dioxide can also perform as a photo-bleaching agent when radiated with radiation having wavelength between about 10 nm and about 1200 nm. Radiation in the ultraviolet spectrum may be less attractive due to potential human exposure issues.

The treatment composition 100 can comprise titanium dioxide in a quantity ranging from about 0.0000001% to about 25% by weight of the treatment composition 100. The treatment composition 100 can comprise titanium dioxide in a quantity ranging from about 0.005% to about 5% by weight. The treatment composition 100 can comprise other components including, but not limited to, surfactants, perfumes, stabilizers, builders, bleaching agents, disinfectants, enzymes, graying inhibitors, brighteners, and the like.

The titanium dioxide can have a particle size between about 2 nm and about 600 nm, or even between about 100 nm and about 400 nm, or event between about 2 nm and about 80 nm. The titanium dioxide can have a specific surface area between about 50 $m^2/g$ to about 400 $m^2/g$. The bulk density of the titanium dioxide can be between about 100 g/l to about 800 g/l. The titanium dioxide can be a carbon modified titanium dioxide having a carbon content of between about 0.01% by weight to about 5% by weight.

The treatment composition 100 can be provided in a liquid, gel, powder, tablet, emulsion suspension, aerosol, or other form.

Photoactivator

The treatment composition 100 can comprise a photoactive component that is a photoactivator. The photoactivator can comprise a photoactive moiety and a hydrophilic moiety. The photoactivator can comprise less than about 35% by weight of the photoactive moiety. The photoactivator can have an absorption band between about 350 nm and about 750 nm, preferably between about 350 nm and about 420 nm.

The photo activator can have the formula:

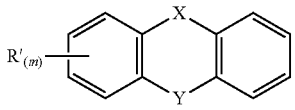

wherein,

X is selected from the group consisting of C, O, NH, C═O, $CH_2$, CHR", CR"R'", S, SO, and $SO_2$;

Y is selected from the group consisting of C, O, NH, C═O, $CH_2$, CHR", CR"R'", S, SO, and $SO_2$;

R', R" and R'" may be —H or selected from a group of substituents that include a moiety selected from the group consisting of Oxygen, Nitrogen, Sulfur, Halogen and Hydrocarbon;

at least one of R', R" or R'" further comprises a hydrophilic moiety R;

R is selected from the group consisting of water soluble oligimers, water soluble polymers and water soluble copolymers;

m is an integer from 0-8; and the combined molecular weight of the substituents R', R" and R'" is greater than 400 atomic mass units (AMU).

The photoactivators of the present invention can comprise a photoactive moiety and a hydrophilic moiety. For purposes of the present invention, the term "hydrophilic moiety" refers to a moiety that is attracted to water and dissolves in water to form a homogenous solution. In one embodiment, the hydrophilic moiety is selected from the group consisting of water soluble oligimers, water soluble polymers and water soluble copolymers. In another embodiment, the hydrophilic moiety may be selected from the group consisting of alkylene oxide oligimers, alkylene oxide polymers, alkylene oxide copolymers, ethylene glycol, vinyl alcohol, vinyl pyrrolidone, acrylic acid, methacrylic acid, acrylamide, cellulose, carboxymethyl cellulose, chitosan, dextran, polysaccharides, 2-ethyl-2-oxazoline, hydroxyethyl methacrylate, vinyl pyridine-N-oxide, diallyl dimethyl ammonium chloride, maleic acid, lysine, isopropyl acrylamide, styrene sulfonic acid, vinyl methyl ether, vinyl phosphoinic acid, ethylene imine, and mixtures thereof. In one embodiment, the hydrophilic moiety may be selected from the group consisting of alkylene oxide oligimer polymers, alkylene oxide oligimer copolymers, vinyl alcohol, vinyl pyrrolidone, acrylic acid, acrylamide, cellulose, and mixtures thereof.

For purposes of the present invention, the term "photoactive moiety" refers to an organic conjugated moiety that is capable of absorbing a photon of light and thereby forming an excited state (singlet or triplet). It will be understood that the term "photoactive moiety does not, however, refer to a charge-transfer excited state. It will further be understood that the photoactive moieties, as disclosed herein, may include a single moiety or a combination of two, three, four or any other number of moieties, as known in the art. The photoactive moiety can be selected from the group consisting of xanthone, xanthene, thioxanthone, thioxanthene, phenothiazine, fluorescein, benzophenone, alloxazine, isoalloxazine, flavin, and mixtures thereof.

Suitable photoactivators are described in detail in U.S. application Ser. No. 61/930,999, filed Jan. 24, 2014, entitled "PHOTOACTIVATORS".

Photocatalyzable Composition

The treatment composition can comprise a photocatalyzable composition that comprises a photoactivator, as described previously, and a benefit active precursor. The benefit active precursor can replace, or be used in addition to, the photoactive bleaching agent described above (e.g. titanium dioxide). The treatment composition can be an aqueous solution.

The benefit active precursor can be selected from oxyhalites, such as chlorite salts, chlorate salts, bromite salts, bromate salts, iodite salts, iodate salts, or mixtures thereof. In one embodiment, the benefit active precursor may be a chlorite salt. The benefit active precursor can be sodium chlorite ($NaClO_2$). In this embodiment, activation of the chlorite salt through transfer of an electron to the photoactivated photocatalyst results in the formation of the benefit active chlorine dioxide ($ClO_2$). Chlorine dioxide is a potent biocide and bleaching agent. Chlorine dioxide kills microorganisms by disruption of the transport of nutrients across the cell wall. In addition to salts, various other precursor forms are contemplated herein.

The photocatalyzable composition can comprise an electron acceptor. For the purposes of the present invention the term "electron donor" is defined as "a compound or moiety which accepts an electron from the photoactivator when the photoactivator is in a photo-excited state and/or one electron reduced state." This electron transfer process is normally a very rapid and reversible process.

The ability of the electron acceptor to accept an electron from the excited photoactivator is generally described in Turro, N. J., V. Ramamurthy, and J. C. Scaiano, *Principles of Molecular Photochemistry: An Introduction*, Chapter 7, p. 41 (University Science Books 2009, Paperback edition). It is understood that the reaction between the reactants is favored when the Gibbs free energy (delta G) is less than 0.

The electron acceptor of the present invention may be any species that accepts an electron from the photoactivator when the photoactivator is in a photo-excited state and/or reduced state. The electron acceptor must be present in the photocatalyzable consumer product composition in sufficient concentration to enable Brownian collisions with the photoactivator, given the concentration of the photoactivator and the lifetime of the photochemically excited state of the photoactivator.

A suitable electron acceptor acceptor can be selected from the group consisting of: viologens, 2,2' bipyridinium, para-Benzoquinone, 2,3-Dichloro-5,6-dicyano-p-benzoquinone, Tetrahydroxy-1,4-quinone hydrate, 2,5-di-tert-butylhydroquinone, tert-Butylhydroquinone, Anthraquinone, Diaminoanthroquinone, Anthraquinone-2-sulfonic acid, Anthracene, Dicyanobenzene, Chloropentaamine cobalt dichloride, Silver nitrate, Iron Sulfate, Titanium Dioxide, Zinc Oxide, Cadmium Selenide, Thiamine hydrochloride, Thiamine pyrophosphate, Ammonium persulfate, Sodium persulfate, Potassium persulfate, (2,2,6,6-Tetramethylpiperidin-1-yl) oxy, Dimethylthiourea, Tetranitromethane, Lithium acetoacetate, Oxaloacetic acid, Sodium ascorbate, 2,6-Dicholorophenolindophenol, 4-methoxyphenol, 4-Methylmorpholine N-oxide, 4-tert-Butylcatechol, Allopurinol, Pyridoxal 5'-phosphate, pyridoxal hydrochloride, Sodium benzoate, Sodium Nitrate, Sodium Nitrite, Diatomic Oxygen, and mixtures thereof.

Suitable photocatalyzable compositions, including suitable benefit active precursors and suitable electron acceptors, are described in detail in U.S. Application Ser. No. 61/930,993, filed Jan. 24, 2014, entitled "CONSUMER PRODUCT COMPOSITIONS".

For laundry treatment compositions, it can be practical to provide a formula that comprises from about 1% to about 25%, or alternatively from about 1% to about 20%, or alternatively about 3% to about 10% by weight photoactivator and from about 1% to about 50%, alternatively from about 3% to about 40%, alternatively from about 5% to about 30% by weight benefit active precursor. Such formulations may be suitable for laundry treatment compositions designed for use in top loading machines that use about 65 L of wash liquor.

For washing machines using a smaller volume of wash liquor, for instance high efficiency front loading machines, it can be practical to provide a formula that comprises from about 0.1% to about 20%, or alternatively from about 0.5 to about 15% to about 20%, or alternatively about 1% to about 10% by weight photoactivator and from about 0.5% to about 50%, alternatively from about 1% to about 40%, alternatively from about 3% to about 30% by weight benefit active precursor.

For dishware treatment compositions, it can be practical to provide a formula that comprises from about 0.1% to about 25%, or alternatively from about 0.1% to about 20%, or alternatively about 0.5% to about 10% by weight photoactivator and 0.01% to about 50%, or alternatively about 0.01% to about 25%, or alternatively about 0.1% to about 10% by weight benefit active precursor.

Package

The treatment composition 100 can be packaged in an opaque package. The package can be formed from materials including, but not limited to, polyethylene, polypropylene, metal, or other material. The package can be opaque to electromagnetic radiation in the wavelength region between about 2 nm and about 1200 nm, or even between about 380 nm to about 800 nm. By opaque, it is meant that transmittance is reduced by more than about 80%, or more than about 90%, or more than about 95%, or more than about 99%, as compared to complete radiation transmission.

Method of Cleaning

A photoactive component can be employed in cleaning and/or treating a substrate. The substrate can be dishware or laundry, or other material. The method for treating a substrate can comprise the steps of: providing a treatment composition 100 comprising a photoactive component; contacting in an appliance the treatment composition with the substrate; and irradiating the treatment composition with visible light. The photoactive component can be a photoactivator.

The step of irradiating the treatment composition 100 with visible light can be performed with a source of light that is tool free insertable into and removable from an interior portion the appliance. By tool free insertable into and removable from an interior portion of the appliance it is meant that the consumer can insert the pertinent structure into the appliance and remove the pertinent structure from the appliance without using any tools that provide mechanical advantage. Rather, she can simply manipulate the thing to be manipulated with only her fingers. The consumer does not need to employ a screwdriver, pliers, hammer, or other implement that provides mechanical advantage to the force that can be provided by the consumer's hand.

The source of light can be, by way of nonlimiting example, a self contained waterproof battery powered lamp having an on and off switch. The appliance can be a household dishwasher and the method can be carried out in a household dishwasher containing dishware in the cabinet of the dishwasher. The dishwasher can be a dishwasher sized for commercial/industrial use.

In an application involving a dishwasher, the user can place the source of light on the floor of the washing space of the dishwasher, rest the source of light on a portion of a rack, place the light in a compartment that is part of the rack or connected to the rack, or other place the source of light within the dishwasher.

The step of irradiating the treatment composition with visible light can be performed with a source of light that is tool free attachable to and detachable from an interior portion of the appliance. In an application involving a dishwasher, the source of light can be, by way of nonlimiting example, hung on a portion of a rack or attached to an interior wall, floor, or ceiling of the interior of the dishwasher.

In an application involving a laundry washing machine, the source of light can be, by way of nonlimiting example, tool free attachable to and detachable from an interior portion of the laundry washing machine. For example, the source of light can be tool free attachable to and detachable from the door of the laundry washing machine, the rotating drum of the laundry washing machine, or if present, the agitator of the laundry washing machine. The rotating drum of the laundry washing machine can be housed in the interior of the laundry washing machine. The method can be conducted with the dispenser 10 described previously. The step of contacting in an appliance the treatment composition with the laundry can be performed in rotating drum of the appliance.

Without being bound by theory, it is thought that for applications involving a laundry washing machine, it can be beneficial to have the source of light attached to some component since most laundry washing machines induce the fabric contained therein to move relative to the drum for at least some portion of the cycle. If the source of light were not attached to something, the source of light would need to be rugged enough such that the source of light could withstand impact with parts of the laundry washing machine as the source of light moves throughout the wash and perhaps even impacts portions of the laundry washing machine. Such a rugged design may be more expensive to produce than a less rugged design.

Figure 5:
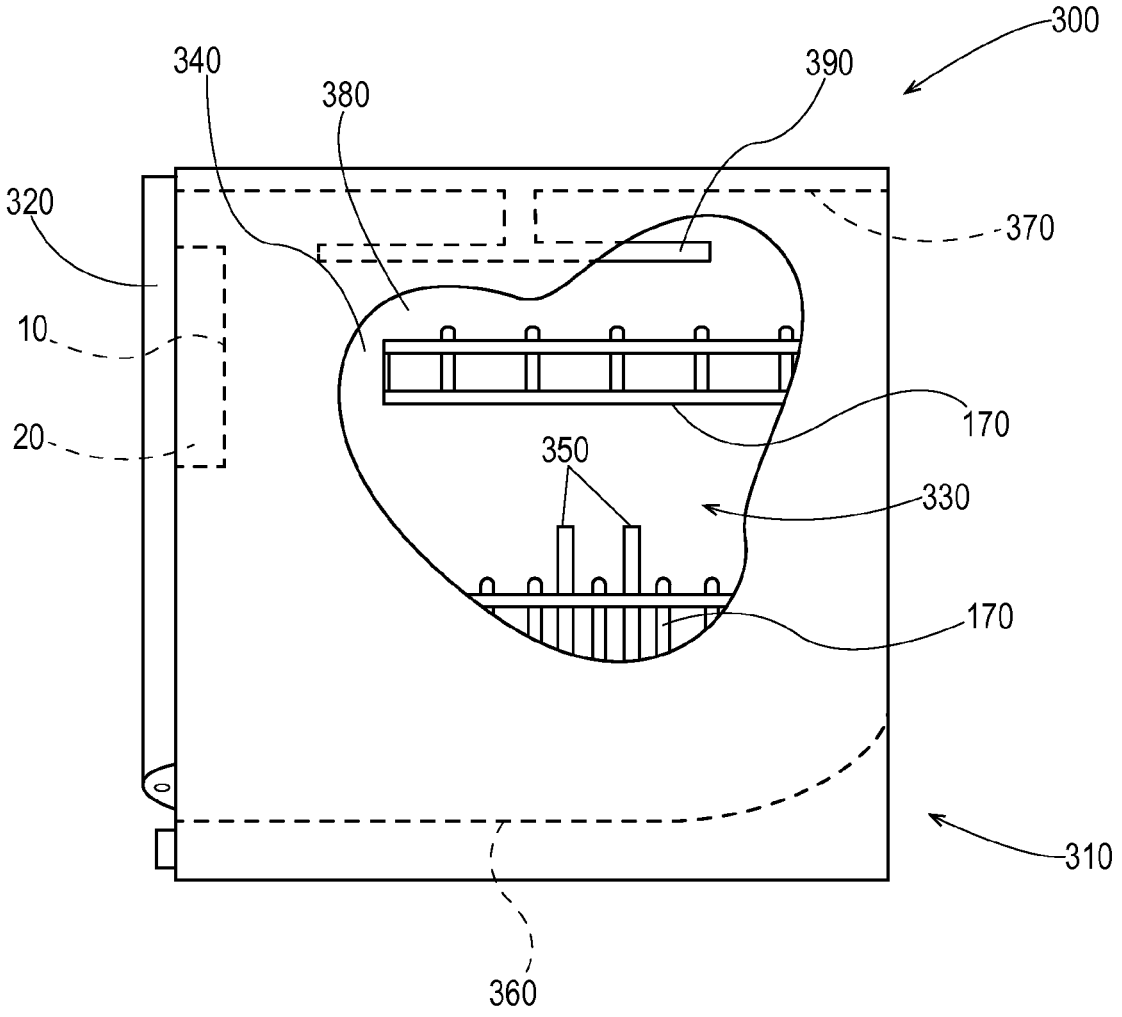
FIG. 5 is an automated dishwasher.

A schematic of an appliance 300 in which a photoactivator or photoactive component can be employed in treating dishware is shown in FIG. 5. The appliance 300 can be an automated dishwasher 310, as shown in FIG. 5. The automated dishwasher 310 can have a door 320 that is openable to provide for access to the interior portion 330. The interior portion 330 can hold dishware 350 that is to be treated, for instance by cleaning and/or disinfecting or other treatment. The interior portion 330 of the dishwasher 310 can be bounded the cabinet 340. The cabinet 340 can have a floor 360 an opposing ceiling 370 connected to one another by walls 380 of the cabinet 340 extending there between. One or more racks 170 can be contained in the cabinet 340. One or more mobile components 390 can be housed within the cabinet 340. The mobile component 390 can be a spindle from which spray arms extend and the spray arms can dispense the wash liquor to the cabinet 340. As shown in FIG. 5, a lighted dispenser 10 having a source of light 20 can be tool free attachable to and detachable from an interior portion 330 of the automated dishwasher 310, for instance, the wall 380 that is formed by the inside surface of the door 320.

Figure 6:
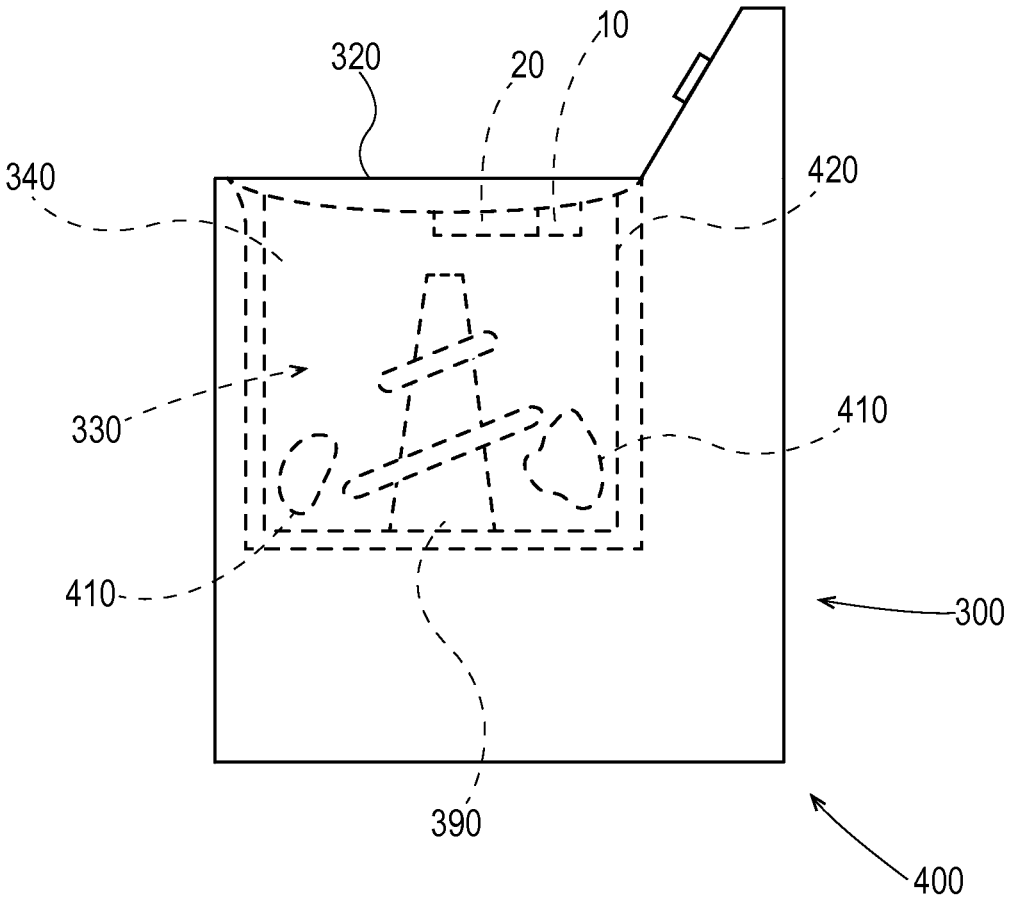
FIG. 6 is an automated laundry washing machine.

The appliance 300 can be an automated laundry washing machine 400, as shown in FIG. 6. The automated laundry washing machine 400 can have a door 320 that is openable to provide for access to the interior portion 330. The interior portion 330 can hold laundry 410 that is to be treated, for instance by cleaning and/or disinfecting or other treatment. The interior portion of the automated laundry washing machine 400 can be bounded by cabinet 340. A rotating drum 420 can be housed in the cabinet 340. A mobile component 390, for example an agitator, can protrude up into the drum 420. As shown in FIG. 6, a lighted dispenser 10 having a source of light 20 can be tool free attachable to and detachable from an interior portion 330 of the automated laundry washing machine 400, for instance, the inside surface of door 320. Alternatively, a lighted dispenser 10 can be free attachable to and detachable from the interior surface of the drum 420.

The source of light 20 can be tool free attachable to and detachable from a mobile component w390 within the appliance 300. For instance, in a laundry washing machine 400, the source of light can be tool free attachable to and detachable from the agitator or the walls of the drum 420. In a dishwasher 310, the source of light 20 can be tool free attachable to and detachable from a rotating spray spindle.

The source of light 20 can be tool free attachable to and detachable from a static component within the appliance. For instance, in a laundry washing machine 400, the source of light 20 can be tool free attachable to and detachable from the door 320 of the laundry washing machine 400. In a dishwasher 310, the source of light 20 can be tool free attachable to and detachable from the floor 360, ceiling 370, walls 380, or door 320 of the dishwasher 310.

It is envisioned that a consumer might employ the photoactive component in a method for cleaning a substrate as follows. The consumer loads the appliance 300 with the substrate to be cleaned. The substrate can be dishware 350 or laundry 410. The appliance 300 can be a dishwasher 310 or laundry washing machine 400. The consumer then puts the treatment composition into the machine in a manner common with current market dishwasher 310 or laundry washing machine 400. For instance, in current market appliances, consumers directly dose the detergent into the cabinet of the machine or dose a detergent dispenser such as a compartment, tray, or pop-open cartridge in the appliance 300.

The photoactive component can be provided as a component to a fully formulated laundry or dish detergent. Alternatively, the photoactive component can be provided in a separate formulation that is limited to the photoactive component or is the photoactive component in combination with other ingredients. If the photoactive component is provided as part of a fully formulated detergent, the consumer can simply dose the fully formulated detergent as direct in the appliance 300 usage instructions or as is ordinarily and customarily done. If the photoactive component is provided separate from the fully formulated detergent, the photoactive component can be dosed directly into the cabinet 340 of the machine or into a dispenser 10. The photoactive component can conceivably be put in the same compartment, tray, or cartridge into which the fully formulated detergent is placed. Optionally, the photoactive component can be put in a dispenser 10 having a reservoir 70.

The consumer can then take steps so that the source of light 20 is turned on either prior to the cleaning cycle or at some appropriate time during the cleaning cycle. The consumer can turn on the source of light 20 before she closes the door of the appliance 300. Optionally, the source of light 20 can be connected in a circuit having a timer or programmable logic controller that turns on the light when desired. The source of light 20 may already be attached to the interior portion 330 of the appliance 300 or the consumer may attach the source of light 20 to an interior portion 330 of the appliance.

The aspect that the source of light 20 is tool free attachable to and detachable from an interior portion 330 of the appliance allows consumers to obtain the advantages for cleaning that can be provided by treatment compositions having a photoactive component using the appliance 300 they presently own. This overcomes the problems with consumers having to purchase a new appliance 300 to obtain the benefit. This also helps the prospective marketer of treatment compositions having a photoactive component in that it is practical for an adequate market size to be created that is big enough to justify investing the capital and other resources into the business of selling treatment compositions having a photoactive component. Without such an approach to utilizing a photoactive component in cleaning soiled substrates, it might never become practical for consumers to be provided with the benefits that can be achieved by such chemistry. By not requiring tools to attach or detach the source of light 20, or dispenser 10, it is convenient an unimposing for the consumer to take the steps necessary to obtain the benefits offered by employing a photoactive component in the wash.

When a cleaning appliance such as a dishwasher 350 or laundry washing machine 400 is in use, the wash liquor is contacted to the substrate being cleaned. The source of light 20 irradiates the treatment composition 100 and or wash liquor to activate the photoactive component. Once such chemistry is activated, the chemistry can perform the desired cleaning. It is contemplated that the photoactive component can be delivered at the start of the wash cycle or at some point during the wash cycle, either automatically or by the consumer opening the appliance and applying the treatment composition 100.

Figure 7:
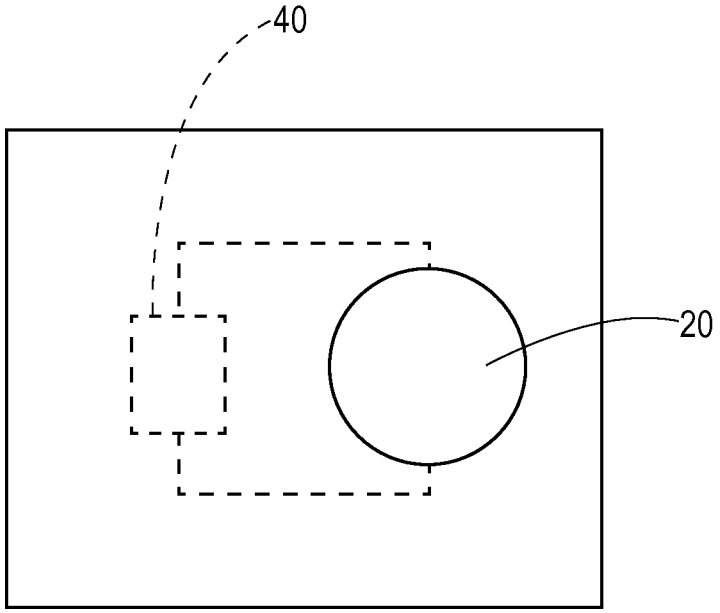
FIG. 7 is a light housing comprising a power source and source of light conductively connected to the power source.

The source of light 20 can be provided by a dispenser 10, for instance as shown in FIG. 1. A light housing comprising a power source 40 and a source of light 20 conductively connected to the power source 40 is shown in FIG. 7. That is, the source of light 20 need not be provided in combination with a reservoir 70, as in FIG. 1.

The treatment composition can be a fully formulated laundry detergent or dish detergent. The treatment composition can comprise the components of any of the formulations of CASCADE dish detergent in liquid, powder, or unit dose form, sold by The Procter & Gamble Co.

Since it is difficult to retrofit an existing appliance to carry out the method disclosed herein, it can be practical for the source of light 20 to have a power source 40 that is independent of the source of power automated dishwasher 310. For instance, the automated dishwasher 310 may be plugged into an electrical outlet or directly connected into an electrical circuit. The power source 40 for the source of light 20 can be a battery.

The step of irradiating the treatment composition 100 with visible light can be performed with a dispenser 10 that comprises a source of light 20 and a reservoir 70 releasably containing the treatment composition 100.

The source of light 20 can be tool free attachable to and detachable from a rack 170.

The appliance can be laundry washing machine, upright or side entry, and the method can be carried out in laundry washing machine 400. The laundry washing machine 400 can be of the type commonly used in households or a laundry washing machine 400 sized for commercial/industrial use or of such size as commonly available in a laundromat.

The treatment composition can comprise the components of any of the formulation of TIDE laundry detergent in liquid, powder, or unit dose form, sold by The Procter & Gamble Co.

Kit

Figure 8:
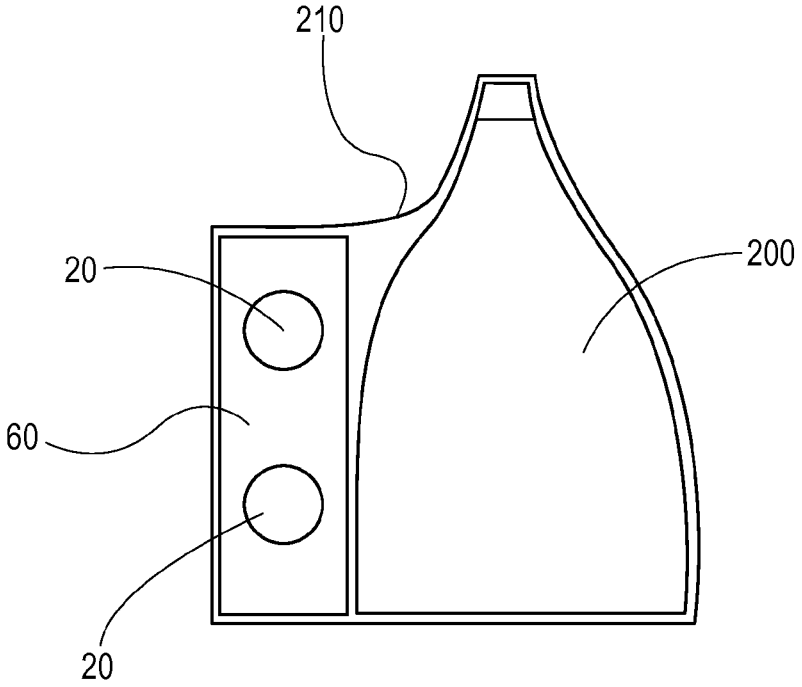
FIG. 8 is a kit that comprises a light housing comprising a power source and a source of light conductively connected to the power source and a treatment composition comprising a photoactivator.

A kit for treating a substrate can also be desirable. It can be practical to provide a kit 190 that comprises a light housing 60 comprising a power source 40 and a source of light 20 conductively connected to the power source 40 and a container 200 containing a photoactive component, for example photocatalyzable treatment composition 100 comprising a photoactivator, as shown in FIG. 8. The light housing 60 and container 200 can be co-packaged with one another, as shown in FIG. 8. A magnet 160 can be operatively connected to the light housing 60. In an application for a dishwasher 310 or laundry washing machine 400, the magnet can be used to attach the light housing 60 to an interior portion 330 of the appliance 300. Alternatively, the light housing 60 need not be provided with a magnet 160 or other structure to attach the light housing 60 to an interior portion 330 of the automated dishwasher 310. The light housing 60 can be placed by the consumer on the floor 360 of the automated dishwasher 310 or on the rack 170 or in a pocket for holding eating utensils on the rack 170.

Without being bound by theory, it is thought that providing a consumer the source of light 20 and the treatment composition 100 in a single kit 190 that consumers might more readily be able to obtain the benefits that can be provided with treatment compositions 100 having a photoactive component. Such a kit 190 can contain instructions on use and information on the prospective benefits that can be obtained. The same treatment composition 100 can be provided independently as well so that the consumer can reuse the source of light 20 that she obtained with treatment composition 100 that is subsequently purchased.

As part of the kit 190, the treatment composition 100 can be provided in an opaque container 200. The container 200 and light housing 60 having a source of light 20 can be co-packaged together by shrink wrap 210. Optionally, the container 200 and light housing 60 having a source of light 20 can be co-packaged together in a carton.

The treatment composition 100 can be a dish cleaning composition or a laundry cleaning composition, by way of nonlimiting example. The treatment composition 100 can be a composition that employs photoactive component to provide other benefits. The treatment composition 100 can be, by way of nonlimiting example, a fabric dyeing composition.

Figure 9:
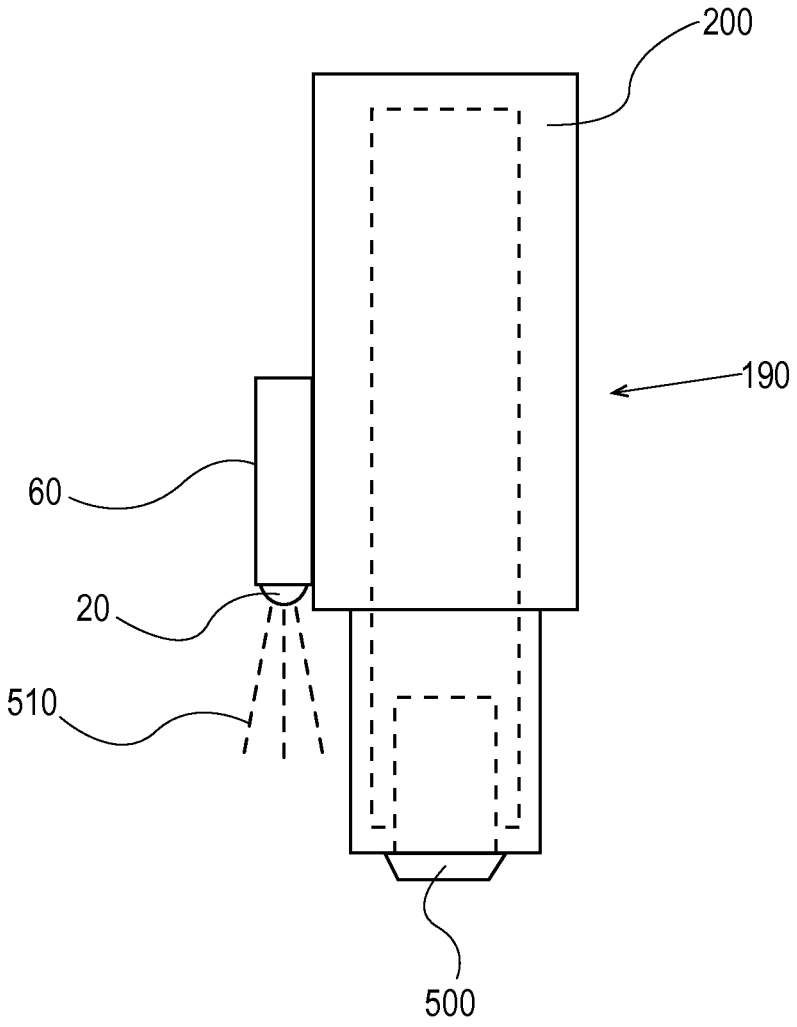
FIG. 9 is a kit that comprises a light housing joined to a container, with an applicator protruding from, and in liquid communication with, the container.

In one embodiment of the kit 190, the light housing 60 and the container 200 are joined to one another. An applicator 500 can protrude from the container 200 and be in liquid communication with the treatment composition 100 contained in the container 200, as shown in FIG. 9. Such a kit can be practical for treating stains in clothing. For example, the user can dispense a quantity of the contents of the container 200 which include a photoactive component onto a stained portion of an article of clothing by rubbing the applicator 500 against the article of clothing. Once the clothing article is wetted, the source of light 20 can be turned on to direct light 510 at the wetted portion of the clothing article. The light can activate the photoactive component to treat the stain on the garment. The photoactive component can be a photoactivated bleach and the activated bleach can bleach the stain being treated. Alternatively, the photoactive component can be titanium dioxide in a treatment composition.

The applicator 500 can be a roll-on ball that transmits contents of the container 200 from within the container 200 to be external to the container 200. The applicator 500 can be a solid or fibrous nib an end of which extends into the container 200.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A kit comprising:

a light housing comprising source of light; and a container containing a photocatalyzable treatment composition comprising a photo activator;

wherein said light housing and said container are co-packaged with one another, and wherein said light housing and said container are joined to one another, wherein an applicator protrudes from said container and is in liquid communication with said photocatalyzable treatment composition in said container.

2. The kit according to claim 1, wherein said light housing is sized and dimensioned to fit within an interior portion of a household appliance.

3. The kit according to claim 1, wherein said source of light is tool free attachable to and detachable from an interior portion of an appliance.

4. The kit according to claim 1, wherein said treatment composition is a fully formulated laundry detergent or a fully formulated dish detergent.

5. The kit according to claim 1, wherein said source of light is tool free attachable to and detachable from a mobile component within an appliance.

6. The kit according to claim 1, wherein said source of light is tool free attachable to and detachable from a rack in a dishwasher.

7. The kit according to claim 1, wherein said source of light is tool free attachable to and detachable from an interior portion of an automated washing appliance.

8. The kit according to claim 1, wherein said source of light is a light emitting diode.

9. The kit according to claim 1, wherein said container comprises a dispensing outlet.

10. The kit according to claim 9, wherein said dispensing outlet is a weep hole.

11. The kit according to claim 1, wherein said light housing is tool free attachable to and detachable from an interior portion of an appliance.

12. The kit according to claim 1, wherein said light housing is operatively connected to a locking member.

13. The kit according to claim 12, wherein said locking member is tool free attachable to and detachable from a carrier.

14. The kit according to claim 13, wherein said locking member is slideably engaged with said carrier.

15. The kit according to claim 13, wherein said carrier comprises an adhesive attached to a side of said carrier opposing said locking member.

16. The kit according to claim 12, wherein said locking member is tool free attachable to and detachable from an interior portion of an appliance.

17. The kit according to claim 1, wherein a magnet is operatively connected to said light housing.

18. The kit according to claim 1, where said source of light provides a radiant flux between about 500 mW and 500 W at a wavelength between about 350 nm and about 750 nm.

19. The kit according to claim 1, wherein the treatment composition comprises from about 0.1% to about 25% by weight of the photo activator.

20. The kit according to claim 1, wherein the treatment composition comprises from about 0.1% to about 10% by weight of the photo activator.

* * * * *